US005742219A

United States Patent [19]

Moalem et al.

[11] Patent Number: 5,742,219

[45] Date of Patent: Apr. 21, 1998

[54] SWITCHABLE CIRCUIT BREAKER

[75] Inventors: Fred Moalem, Shelton, Conn.; John R. Joyce, Jr., Haubstadt, Ind.

[73] Assignee: Siemens Electromechanical Components, Inc., Princeton, Ind.

[21] Appl. No.: 234,750

[22] Filed: Apr. 28, 1994

[51] Int. Cl.[6] ..... H01H 71/16

[52] U.S. Cl. ..... 337/68; 337/37; 337/53; 337/56; 337/91

[58] Field of Search ..... 337/37, 53, 56, 337/68, 89, 91

[56] References Cited

U.S. PATENT DOCUMENTS

| | | | |
|---|---|---|---|
| 2,318,076 | 5/1943 | Johns | 318/476 |
| 2,783,330 | 2/1957 | Casey | 337/53 |
| 2,856,487 | 10/1958 | Mang | 337/53 |
| 3,846,729 | 11/1974 | Sorimachi | 337/53 |
| 4,123,737 | 10/1978 | Hoagland | 337/68 |
| 4,363,016 | 12/1982 | Unger | 337/56 |
| 4,510,479 | 4/1985 | Merchant | 337/56 |
| 4,518,943 | 5/1985 | Giessner | 337/68 |
| 4,833,439 | 5/1989 | Bowden | 337/68 |
| 4,868,535 | 9/1989 | Janniere | 337/68 |
| 5,248,954 | 9/1993 | Chiang | 337/68 |

*Primary Examiner*—Leo P. Picard
*Assistant Examiner*—Jayprakash N. Gandhi
*Attorney, Agent, or Firm*—Joseph S. Codispoti

[57] ABSTRACT

A switchable circuit breaker having a housing, stationary and moveable contacts, a switching member for actuating the contacts to assume a first condition in which the contacts are open and a second condition in which the contacts are closed, and a breaker is disposed within the housing to interrupt current flow through the contacts in response to the current flow exceeding a predetermined level. The switching member includes a pusher moveable between an advanced position in which the pusher acts on the contacts to assume a contact opening condition and a retracted position in which the pusher releases the contacts to assume a contact closing position. The pusher is guided within the housing so as to convert a linear motion of its drive end into a steplike motion of its active end in order to provide a snapping transition between the closing and opening conditions of the contacts, thus assuring "non-teaseability" in the switching operation.

22 Claims, 3 Drawing Sheets

SWITCHABLE CIRCUIT BREAKER

TECHNICAL FIELD

This invention relates to electrical switches and circuit breakers, and more particularly to a switchable circuit breaker.

BACKGROUND OF THE INVENTION

Circuit breakers are used in electric and electronic systems in which components must be protected from abnormal current conditions.

A typical circuit breaker using a tripping mechanism of the bimetallic type is described in U.S. Pat. No. 4,363,016 to Unger. In this known device a rocker button is provided for resetting the tripped circuit breaker. However, there is no possibility of manually switching the contacts from an "ON" to an "OFF" condition.

A unitary switch and circuit breaker is disclosed in U.S. Pat. No. 4,833,439 to Bowden et al. In this known device a rocker has a projecting arm to directly act on a bimetallic breaker strip for manually closing or opening a pair of contacts. In this case, the contacts have to be disposed close to the rocker side of the circuit breaker housing in order to render a direct actuation by the rocker possible. That may produce insulation problems due to the short distance between the contacts carrying large currents and the hand actuated rocker. Another problem may result from the fact that in this known device the closing or opening speed of the contacts when being switched corresponds directly to the rotational speed of the rocker. A slow or incomplete actuation of the rocker may result in a slight touching of the contacts or in an incomplete contact closing which may produce an undesirable arcing, while the rocker returns to its start position (so-called "teaseability").

SUMMARY OF THE INVENTION

It is thus an object of the present invention to overcome the aforesaid defects of the existing art.

It is another object of the present invention to provide a unitary switch and circuit breaker having a small number of components and being compact and small in size, in particular concerning height and width.

It is a further object of the present invention to provide a switchable circuit breaker that can be used to perform both the switching function and the circuit breaker function.

It is still a further object of the present invention to provide a unitary switch and circuit breaker in which placing the switch in the "ON" condition resets the circuit breaker function.

It is yet object of the present invention to provide a switchable circuit breaker in which actuating the switch function avoids slow motion of the contact opening or closing action, respectively, and avoids also indefinite and incomplete contact closing conditions (so-called "non-teaseability").

The above and other objects are obtained by the present invention which provides a switchable circuit breaker comprising:

a housing;

a pair of contacts disposed within said housing;

switching means for actuating said contacts to assume a first condition in which said contacts are open and a second condition in which said contacts are allowed to close; and breaker means disposed within said housing to interrupt current flow through said contacts in response to said current flow exceeding a predetermined level and in response to actuation of said switching means to open said contacts;

said switching means including a pusher member, having a front active end and a rear drive end, that is arranged in said housing so as to be movable between an advanced position in which said active end acts on said contact to assume said first condition and a retracted position in which said pusher releases the contacts to assume said second condition;

said pusher member being guided within said housing so as to convert a linear motion of its drive end into a step-like motion of its active end in order to provide a snapping transition between said closing and opening conditions and vice versa of the contacts.

BRIEF DESCRIPTION OF THE DRAWINGS

For a better understanding of the invention, reference is made to the following description of an exemplary embodiment thereof, and to the accompanying drawings, wherein.

DETAILED DESCRIPTION

Figure 1:
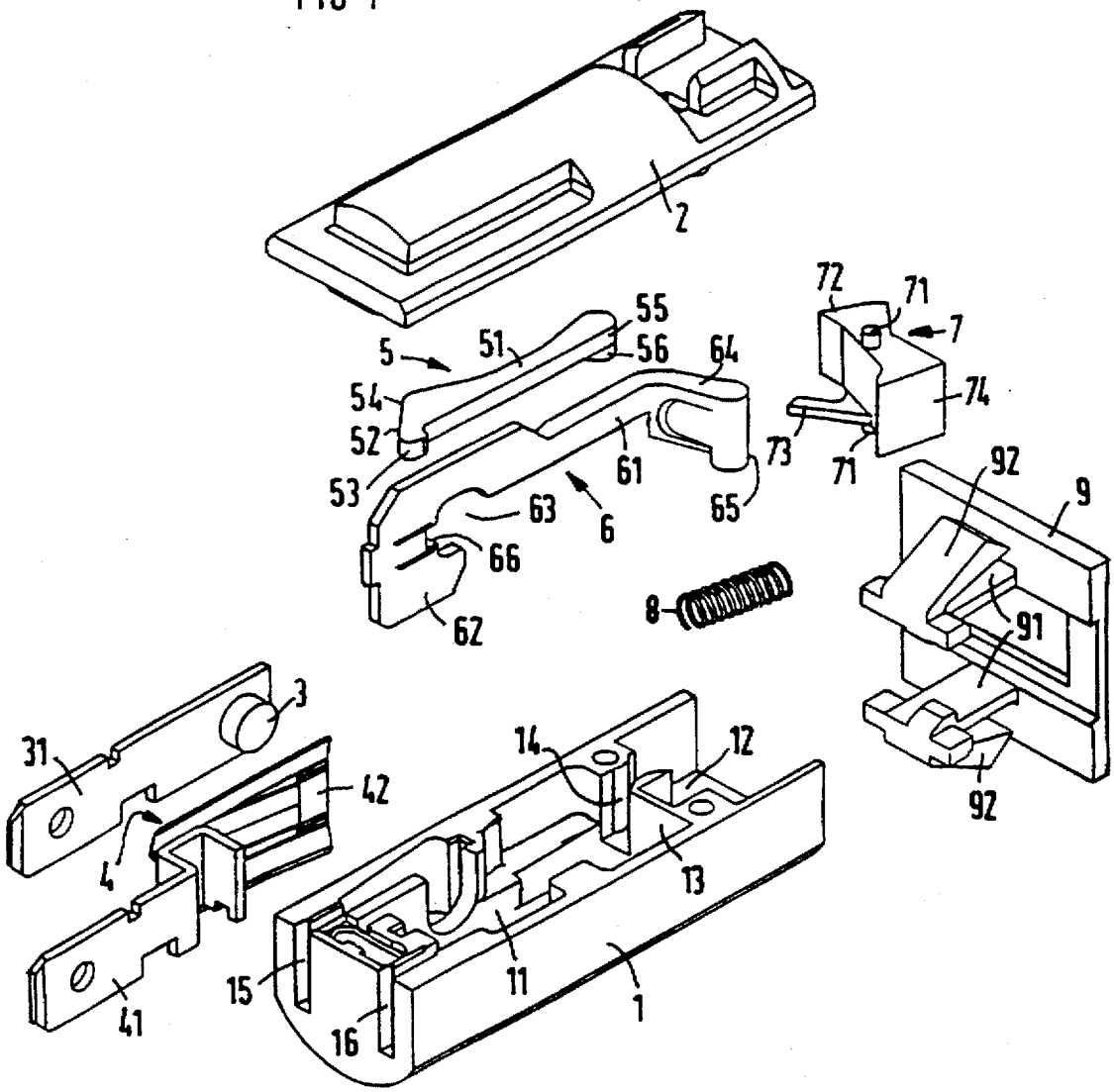
FIG. 1 is an exploded, perspective view illustrating the component parts of a switchable circuit breaker in accordance with the present invention.
Figure 2:
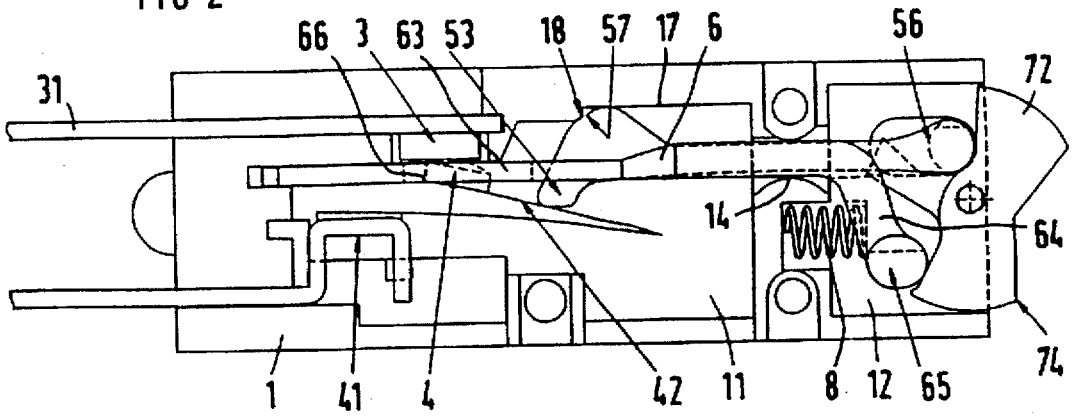
FIG. 2 is a side of view of the switchable circuit breaker of FIG. 1, showing the assembled parts in the open housing, the switchable circuit breaker being in "ON" position.

Referring to the drawings, and initially to FIGS. 1 and 2, the preferred embodiment of a switchable circuit breaker includes an elongated housing comprising a trough-like case 1 and a cover 2 which is to be mounted on the open side of the case 1. The case 1 and the cover 2 are molded from an electrically-insulated plastic material. The case 1 defines an elongate contact chamber 11 and a separate driving chamber 12 separated from each other by a separating wall 13. The contact chamber 11 is adapted to receive a stationary contact 3 carried by a stationary contact terminal 31 and a moveable contact 4 carried by a bimetal blade spring 42 and a movable contact terminal 41. The terminals 31 and 41 are mounted in slots 15 and 16 of the case 1, so as to place the contacts 3 and 4 opposite to each other.

A pusher 5 and a slide 6, both made from insulating material, are disposed in the case 1 and guided with central or intermediate portions 51 and 61, respectively, in a guiding gap 14 of the separating wall 13. The guiding gap 14 is the only passage between the contact chamber 11 and the driving chamber 12. The intermediate portions 51 and 61 of the pusher 5 and the slide 6 are small in thickness and reduced in width, so they can be guided in a common plane side by side in the guiding gap 14 and the guiding gap can be narrow so as to provide sufficient insulation between the contact chamber 11 and the driving chamber 12. The driving chamber has an open end side in which a rocker 7 is pivotally mounted between the case 1 and the cover 2, for example by means of pivot pins 71. The pusher 5 has a front active end 52 with an actuating finger 53 directed to the bimetal blade spring 42 carrying the moveable contact 4, and a cam portion 54 formed on the side opposite to the moveable contact 4. Further, the pusher 5 has a rear driving end 55 disposed in said driving chamber 12 and engaging a first rocker arm 72. Further, a retracting pin 56 is formed downward on said rear driving end 55 which is engageable with a retracting arm 73 formed at a lower portion of the rocker 7.

The slide 6 forms a non-conducting portion 62 at its front end which is to be disposed between a stationary contact 3 and a moveable contact 4 when in a contact opening condition. Further, a recess 63 is formed on the slide 6 through which the contacts 3, 4 can be closed when the slide is in an advanced position and the breaker mechanism, i.e. the bimetal spring 42, is not in a "TRIPPED" condition. As noted, the slide 6 is guided in the common guiding gap 14 with the pusher 5, which is in alignment with the first rocker arm 72. The slide 6 has a cranked portion 64 in the driving chamber 12 so as to engage with a rear end 65 a corresponding second rocker arm 74. A compression or helical spring 8 is arranged in the driving chamber 12; this spring 8 is supported on the separating wall 13 and acts against the cranked portion 64 of the slide in order to urge the slide 6 against the second rocker arm 74 and into a contact opening position.

For assembling the switchable circuit breaker, all the functioning parts can be mounted in the case 1 and then secured in their mounting position by fastening the cover 2 on the open side of the case 1. Further, a front panel or bezel 9 can be snapped over the open housing side and over the rocker 7, this bezel 9 securing case 1 and the cover 2 together by means of clamping arms 91. Further, the whole circuit breaker can be inserted into a panel opening and secured there by means of resilient snapping arms 92.

The operation of the switchable circuit breaker is next to be described.

Referring to FIG. 2, the switchable circuit breaker is illustrated to be in its "ON" position or contact closing position. The moveable contact 4 is urged by the spring force of the bimetal blade spring 42 against the stationary contact 3 through the recess 63 of the slide 6 which is now in an advanced position. The rocker 7 is also in its "ON" position so that its second arm 74 contacts the rear end 65 of the slide 6. The closed moveable contact 4 abuts a shoulder 66 of the slide 6 keeping the slide in an advanced position against the retracting force of the compression spring 8 which is exerted against a cranked portion 64 of the slide 6. The pusher 5 is in a retracted position so that its actuating finger 53 touches only slightly the bimetal spring 42 and its cam portion 54 rests at a side wall 17 and a step 18 of the case 1.

Figure 3:
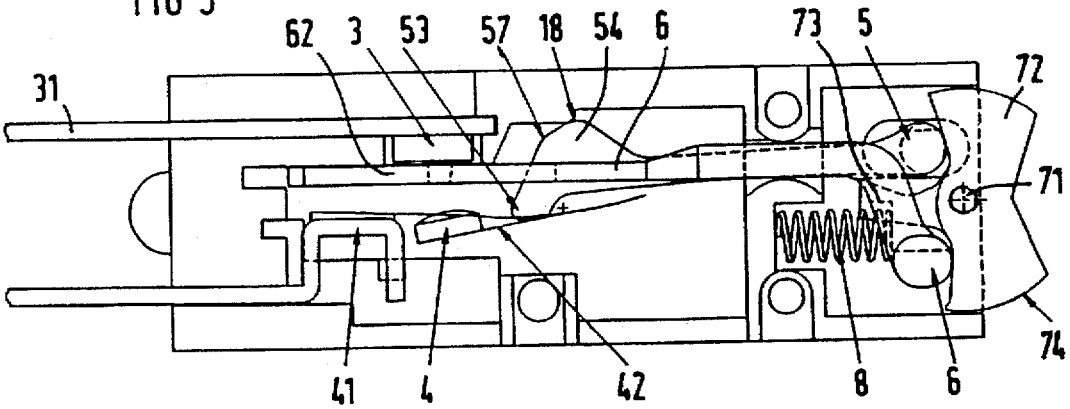
FIG. 3 is a side view as in FIG. 2, showing the switchable circuit breaker in "TRIPPED" position.

If a current flowing across the contacts 3, 4 exceeds a predetermined value, the bimetal blade spring 42 will flex and snap, causing the moveable contact 4 to travel downwardly (in FIG. 2) and, thereby be displaced out of the plane of the slide 6 and out of the recess 63. With the moveable contact 4 disengaged from abutting with the shoulder 66, the spring 8, being biased against the cranked portion 64 of the slide 6, urges the rear end 65 of the slide and pushes the slide to move to the right in FIG. 2 and interpose with its non-conducting portion 62 between the contacts 3, 4. As a result of the slight movement, the rocker arm 74 is urged in an outward direction causing the rocker 7 to rotate in counter clockwise direction which causes the first rocker arm 72 to shift the pusher 5 in the left direction. The front end 52 then sits between the bimetal spring 42 and the step 18 of the casing. The rocker will be positioned in an intermediate "ON" and "OFF" position, indicating a "TRIPPED" condition as illustrated in FIG. 3.

Now a switching operation from "ON" position (FIG. 2) to "OFF" position (FIG. 5) is to be described.

Figure 4:
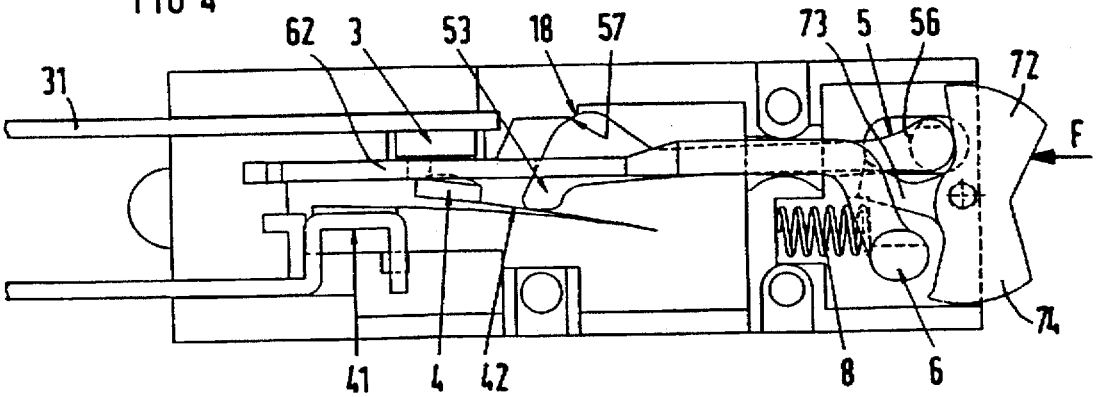
FIG. 4 is a side view as in FIG. 2, showing an intermediate position from "ON" to OFF" position.
Figure 5:
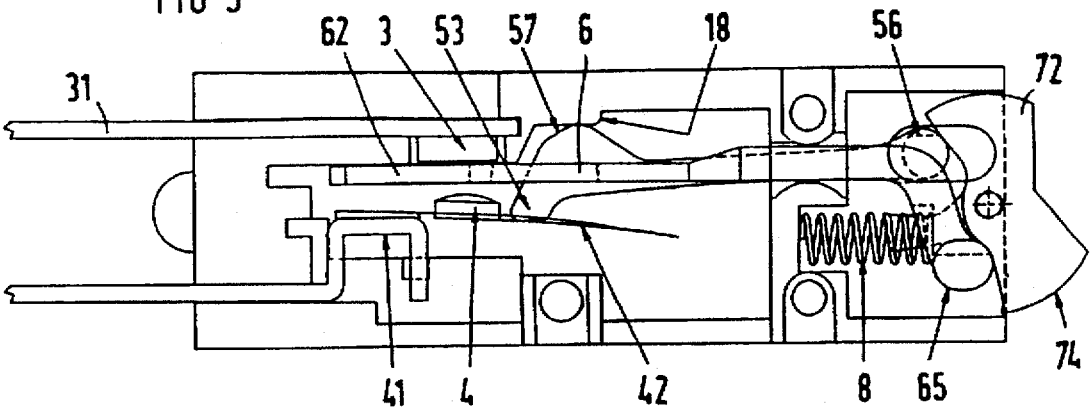
FIG. 5 is a side view as in FIG. 2, showing the switchable circuit breaker in OFF" position.

As a force F is applied manually to turn the circuit breaker to the "OFF" position, the rocker 7 rotates in a counter clockwise direction and pushes the pusher 5 to the left. The pusher has at its cam portion 54 a ramp 57 which has to be moved over the step 18 on the case 1 causing the pusher to have a downward motion in FIG. 4. This motion will cause the actuating finger 53 of the pusher 5 to separate the moveable contact 4 from the stationary contact 3 by exerting a downward force on the bimetal spring 42. Due to the step 18, the separation of contacts will occur in a step-like or snapping manner, avoiding thus slow motion in the contact opening operation. The separation of contacts will allow the non-conducting portion 62 of the slide 6 to interpose between the contacts by the spring force of the compression spring 8. The pusher 5 holds off the bimetal spring 42 not allowing the moveable contact 4 to move to its closed position or touch the slide surface (FIG. 5). In order to reduce so-called "tease-ability" from "ON" to "OFF" position, the breaker is designed such that the contacts will not start to separate until the pusher ramp 57 reaches the step 18 and starts moving down the step. This will allow the bimetal spring force and its direction relative to the pusher ramp 57 to push the pusher 5 back to its "ON" position (closed contacts), if the operator should release the rocker 7 before the slide 6 has interposed between the contacts (FIG. 3). In order to apply the above principle during the entire pass from "ON" to "OFF" position, the slide 6 with its non-conducting portion 62 should interpose between the contacts 3, 4 before the pusher 5 clears the step 18.

Now a switching operation from "OFF" to "ON" position is to be described.

Figure 6:
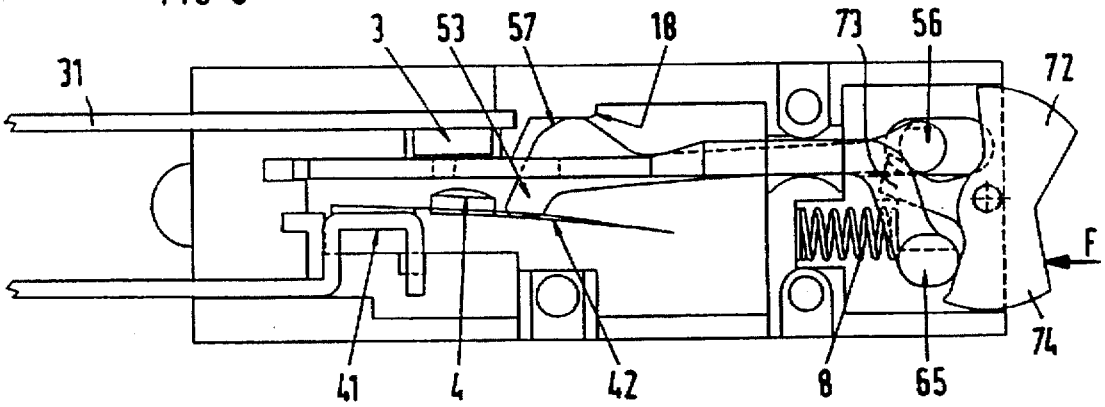
FIG. 6 is a side view as in FIG. 2, showing a first intermediate position from OFF to "ON" position.
Figure 7:
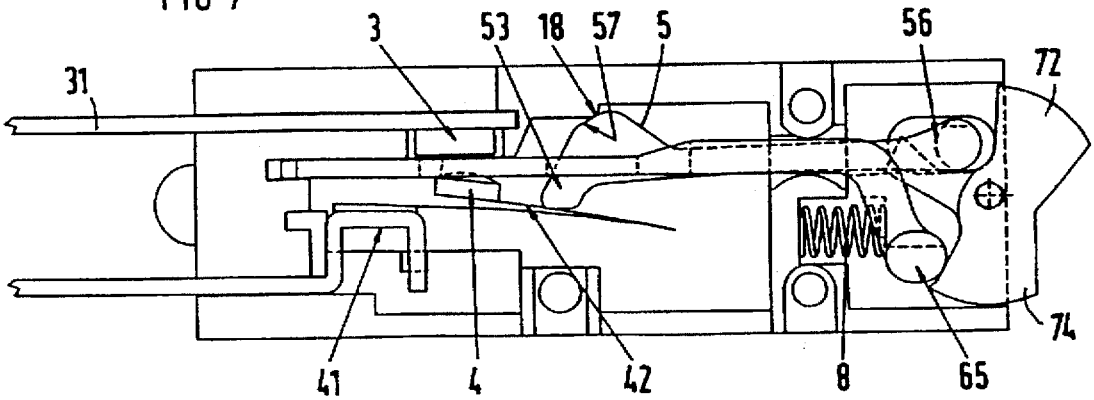
FIG. 7 is a side view as in FIG. 2, showing a second intermediate position from OFF to ON position.

As illustrated in FIG. 6, a manual force F is applied to turn the circuit breaker from its "OFF" position (or "TRIPPED" position according to FIG. 3) to the "ON" position (FIG. 6). The rocker 7 and its projecting retracting arm 73 move in a clockwise direction. As can clearly be seen from FIG. 5, there is a considerable clearance between the projecting arm 73 and the retracting pin 56 of the pusher 5 when the rocker is in the "OFF" position. Thus, the projecting arm 73 will engage the retracting pin 56 not earlier than the rocker has rotated a predetermined angle as shown in FIG. 6. Before the projecting arm 73 reaches the retracting pin 56 of the pusher 5, the only significant forces are the manual force F and the spring forces. Therefore, if the manual force F is removed at anytime during this period, the rocker 7 will return to its "OFF" position FIG. 5). As the rocker 7 moves in the clockwise direction, it will also push the slide 6 to the left allowing its recess 63 to align with the contacts 3, 4. When the projecting arm 73 touches and pulls back the pusher FIG. 7), the moveable contact 4 will drop through the recess 63 in the slide 6 and touch the stationary contact 3. This eliminates tease-ability from "OFF to "ON" position.

It is to be noted, that the position of the rocker 7 indicates with its angle position the condition of the switching and the circuit breaker mechanism, the end position as in FIG. 2 shows the switched "OFF" condition, the end position of the rocker 7 in counter clockwise direction as in FIG. 5 shows the switched "OFF" condition while an intermediate position of the rocker 7 as in FIG. 3 shows the TRIPPED condition of the circuit breaker.

While there has been described herein what is considered to be the preferred embodiment of the invention, other modifications may occur by those skilled in the art, and it is intended that the appended claims are to cover by such modifications which fall within the true spirit and scope of the invention.

What we claim is:

1. A switchable circuit breaker comprising:

a housing;

a pair of contacts disposed within said housing;

switching means for actuating said contacts to assume a first condition in which said contacts are open and a second condition in which said contacts are allowed to close; and breaker means disposed within said housing to interrupt current flow through said contacts in response to said current flow exceeding a predetermined level and in response to actuation of said switching means to open said contacts, said switching means including a pusher member, having a front active end and a rear drive end, that is arranged in said housing so as to be movable between an advanced position in which said active end acts on said contacts to assume said first condition and a retracted position in which said pusher member releases the contacts to assume said second condition, said pusher member being guided within said housing so as to convert a linear motion of its drive end into a step-like motion of its active end in order to provide a snapping transition between said closing and opening conditions and vice versa of the contacts.

2. The switchable circuit breaker of claim 1, wherein said switching means further includes an actuator pivotally mounted in said housing and engaging said rear end of said pusher member for translating a rotational motion of the actuator into a linear motion of said rear end of the pusher member.

3. The switchable circuit breaker of claim 2, wherein said actuator is a rocker having a pair of arms rotating about a central axis therebetween, one of said rocker arms engaging said pusher member.

4. The switchable circuit breaker of claim 1, further comprising a blade spring mounted in said housing and carrying one of said contacts, said active end of said pusher member forming an actuating finger attacking said blade spring in said advanced position of the pusher member, and said active end further forming on its side opposite to said blade spring a cam portion co-operating with a step or ramp section formed within said housing.

5. The switchable circuit breaker of claim 4, wherein said breaker means includes a bimetal spring, said contact-carrying blade spring being part of or connected to said bimetal spring.

6. The switchable circuit breaker of claim 1, said breaker means includes a slide member having a non-conducting portion for interposing between said contacts to subsequently prevent the resumption of current flow until reset, said slide member being biased in a direction as to essentially immediately interpose said non-conducting portion between said contacts in response to any opening movement of the contacts caused either by said breaker means or by said switching means.

7. The switchable circuit breaker of claim 6, wherein said switching means further includes a rocker having first and second rocker arms rotating about a central axis therebetween to assume alternately a first contact opening position and a second contact closing position, said first rocker arm engaging said pusher member when rotating into a first direction to assume said first contact opening position and said second rocker arm engaging said slide member against said biasing force when rotated in a second direction to assume said second contact closing position.

8. The switchable circuit breaker of claim 7, wherein said rocker further comprises a projecting gripping arm for retracting said pusher member while said rocker is rotated into said second contact closing position.

9. The switchable circuit breaker of claim 8, wherein said rear end of said pusher member has a projection which is engaged by said projecting gripping arm of the rocker only after the rocker has rotated by a predetermined angle to said second contact closing position.

10. A switchable circuit breaker comprising:

an elongated housing;

a pair of stationary and moveable contacts disposed within said housing;

switching means for actuating said moveable contact to assume a first contact opening condition and a second contact closing condition; and breaker means including a bimetal spring carrying said moveable contact and disposed within said housing to interrupt current flow through said contacts in response to said current exceeding a predetermined level, said switching means including an elongated pusher member, having a rear drive end and a front active end, that is guided in said housing so as to be moveable in a longitudinal direction between an advanced position in which its active end attacks said bimetal spring as to keep said moveable contact in a contact opening condition and a retracted position in which the pusher member releases said bimetal spring so as to allow said moveable contact to assume said contact closing condition, and said breaker means further comprising an elongated slide member, having a non-conducting portion, that is guided in said housing and biased by a spring so as to interpose said non-conducting portion between said contact members in said contact opening condition.

11. The switchable circuit breaker of claim 10, wherein said active end of said pusher member forms an actuating finger attacking said bimetal spring and forms on its side opposite to said bimetal spring a cam portion cooperating with a ramp or step portion in the housing so as to convert a longitudinal motion of the rear end of the pusher member into a snappingly transverse motion of its active end.

12. The switchable circuit breaker of claim 10, wherein said switching means further comprises a rocker pivotally mounted in said housing and having first and second rocker arms extending on opposite sides of its pivot axis, said first rocker arm engaging said rear end of said pusher member when rotated in one direction to assume a first contact opening position and said second rocker arm engaging said slide member when rotated in a second direction to assume a second contact closing position, the slide member being urged against said second rocker arm by said biasing spring.

13. The switchable circuit breaker of claim 12, wherein said slide member is urged against said rocker arm by means of a compression spring supported in said housing.

14. The switchable circuit breaker of claim 12, wherein said pusher member further comprises a retracting pin extending from its rear end parallel to the pivot axis of said rocker and said rocker further comprises a projecting gripping arm engaging said retracting pin when said rocker is rotated in said second direction to assume said contact closing position.

15. The switchable circuit breaker of claim 14, wherein a clearance is provided between said projecting gripping arm of the rocker and said retracting pin of the pusher member so as to start retracting action of said pusher member not before said rocker has been rotated a predetermined angle.

16. The switchable circuit breaker of claim 12, said housing comprising a generally trough-like case and a cover, said case being divided by a separating wall into a contact chamber and a driving chamber, said contact chamber receiving said contacts, said bimetal spring, said front active end of the pusher member and said non-conducting portion of said slide member, said driving chamber receiving said rocker, said rear driving end of the pusher member and a rear end of said slide member, and said separating wall providing at least one gap for guiding intermediate portions of said pusher member and said slide member, respectively.

17. The switchable circuit breaker of claim 16, wherein said pusher member and said slide member each have a flat intermediate portion guided side by side in a common guiding gap of said separating wall in alignment with said first arm of the rocker, said slide member having a cranked rear end portion in the driving chamber so as to engage said second rocker arm.

18. The switchable circuit breaker of claim 17, wherein said biasing spring is seated in said driving chamber against said separating wall as to act on said cranked rear end of said slide.

19. The switchable circuit breaker of claim 16, wherein said rocker is pivotally mounted between said case and said cover by means of pivot pins captured between the rocker and said case and said cover.

20. The switchable circuit breaker of claim 16, wherein said rocker is pivotally mounted between said case and said cover by means of pivot pins provided on said rocker and rotatable in pivot holes provided in said case and said cover.

21. The switchable circuit breaker of claim 16, wherein said rocker is pivotally mounted between said case and said cover by means of pivot pins provided on said case and said cover and rotatable in pivot holes provided in said rocker.

22. The switchable circuit breaker as in claim 12, wherein said biasing spring is so dimensioned as to urge said rocker into an intermediate "TRIPPED" position after said breaker means has interrupted current flow through said contacts, the rocker being only manually rotatable into one of said contact closing or contact opening end positions, respectively.

* * * * *